US010098817B2

(12) United States Patent
Tegborg et al.

(10) Patent No.: US 10,098,817 B2
(45) Date of Patent: Oct. 16, 2018

(54) DISPENSING DEVICE

(71) Applicant: Sensidose AB, Uppsala (SE)

(72) Inventors: Lars Tegborg, Stockholm (SE); Jack Spira, Tyreso (SE)

(73) Assignee: Sensidose AB, Uppsala (SE)

( * ) Notice: Subject to any disclaimer, the term of this patent is extended or adjusted under 35 U.S.C. 154(b) by 0 days.

(21) Appl. No.: 14/763,530

(22) PCT Filed: Jan. 24, 2014

(86) PCT No.: PCT/GB2014/050188
§ 371 (c)(1),
(2) Date: Jul. 27, 2015

(87) PCT Pub. No.: WO2014/114943
PCT Pub. Date: Jul. 31, 2014

(65) Prior Publication Data

US 2016/0038377 A1 Feb. 11, 2016

(30) Foreign Application Priority Data

Jan. 25, 2013 (GB) ..... 1301370.1

(51) Int. Cl.
*A61J 7/00* (2006.01)
*A61J 7/02* (2006.01)
(Continued)

(52) U.S. Cl.
CPC ..... *A61J 7/0076* (2013.01); *A61J 7/02* (2013.01); *B65D 83/0409* (2013.01);
(Continued)

(58) Field of Classification Search
CPC ..... A61J 7/044
See application file for complete search history.

(56) References Cited

U.S. PATENT DOCUMENTS 1,976,351 A 10/1934 Matthiesen
2,075,988 A 4/1937 Johnson
(Continued)

FOREIGN PATENT DOCUMENTS

EP 0078126 A2 5/1983
EP 1 058 660 A1 12/2000
(Continued)

OTHER PUBLICATIONS

International Search Report for corresponding Patent Application No. PCT/EP2009/008253 dated Jul. 21, 2010.
(Continued)

*Primary Examiner* — Gene O Crawford
*Assistant Examiner* — Ayodeji T Ojofeitimi
(74) *Attorney, Agent, or Firm* — Renner, Otto, Boisselle & Sklar, LLP

(57) ABSTRACT

A device for dispensing articles, the device comprising: a conveying member comprising n receptacles, of which n−m are suitable for receiving articles, the receptacles being movable between an article receiving position and an article dispensing position; a sensor for sensing the presence of articles in the receptacles, the sensor positioned between the receiving position and the dispensing position; wherein m of said receptacles is a blank receptacle which is unable to receive an article and the sensor is unable to distinguish an empty receptacle from a blank receptacle such that the maximum number of detectable articles conveyed once n receptacles have passed the sensor is n−m, where m is at least 1.

20 Claims, 7 Drawing Sheets

(51) Int. Cl.
*B65D 83/04* (2006.01)
*G08B 21/18* (2006.01)

(52) U.S. Cl.
CPC ..... *G08B 21/18* (2013.01); *G08B 21/187* (2013.01); *A61J 2200/70* (2013.01)

(56) References Cited

U.S. PATENT DOCUMENTS

| | | | | |
|---|---|---|---|---|
| 2,712,374 | A | 7/1955 | Smith et al. | |
| 3,301,437 | A | 1/1967 | Faber | |
| 3,332,575 | A | 7/1967 | Pilot et al. | |
| 3,828,972 | A | 8/1974 | Bender | |
| 4,308,974 | A | 1/1982 | Jones | |
| 5,351,858 | A | 10/1994 | Bar-Yona et al. | |
| D392,481 | S | 3/1998 | Perkitny | |
| 5,791,515 | A | 8/1998 | Khan et al. | |
| 6,263,259 | B1 | 7/2001 | Bartur | |
| 6,880,772 | B2 | 4/2005 | Schlesiger et al. | |
| 7,831,336 | B2 | 11/2010 | Gumpert | |
| 2005/0150488 | A1 | 7/2005 | Dave | |
| 2005/0174216 | A1 | 8/2005 | Lintell | |
| 2005/0177275 | A1 | 8/2005 | Harvey et al. | |
| 2011/0006073 | A1* | 1/2011 | Karwacki, Jr. | G07F 9/026 221/1 |
| 2011/0295416 | A1* | 12/2011 | Aquilonius | A61J 7/0076 700/232 |
| 2013/0131863 | A1* | 5/2013 | Hoersten | G07F 9/026 700/236 |

FOREIGN PATENT DOCUMENTS

| | | | |
|---|---|---|---|
| GB | 2465764 | A | 6/2010 |
| GB | 2480835 | A | 12/2011 |
| WO | 97/01157 | | 1/1997 |
| WO | 99/23014 | | 5/1999 |
| WO | 2005/035391 | | 4/2005 |
| WO | 2006/116370 | A2 | 11/2006 |
| WO | 2008/125128 | | 10/2008 |
| WO | 2010/060568 | A2 | 6/2010 |

OTHER PUBLICATIONS

Search Report for corresponding Patent Application No. GB 0821672.3 dated Mar. 10, 2009.

Anonymous; "Carbidopa/Levodopa Dosage—Drugs.com", Mar. 14, 2010, XP055165593, Retrieved from the Internet: URL; https://web.archive.org/web/20100314033238/http://www.drugs.com/dosage/carbidopa-levodopa.html#Usual_Adult_Dosage_for_Parkinson_s_Disease.

International Search Report and Written Opinion for corresponding patent application No. PCT/GB2014/050188 dated Jun. 11, 2014.

Search Report for corresponding Patent Application No. GB1301370.1 dated May 17, 2013.

* cited by examiner

DISPENSING DEVICE

This application is a national phase of International Application No. PCT/GB2014/050188 filed Jan. 24, 2014 and published in the English language.

The invention relates to a dispensing device, such as a device for dispensing articles including pharmaceutical tablets.

The drug therapies used to treat or otherwise control a number of chronic diseases such as, but not limited to, Parkinson's disease, epilepsy, cancer, depression, schizophrenia, attention deficit-hyperactivity disorder (ADHD) as well as other neurobehavioral disorders diabetes, arthritis and asthma and diseases requiring anti-coagulants, anti-arrhythmics and/or analgesia often have a narrow therapeutic window and produce significant side effects when dosing is non-optimal.

The timing of doses as well as the amount of the dose is therefore critical to maintain drug levels within desired levels and it is important that administered doses are as accurate as possible to reduce the effects that can otherwise arise from over, under or imprecise dosing.

The listing or discussion of an apparently prior-published document in this specification should not necessarily be taken as an acknowledgement that the document is part of the state of the art or common general knowledge.

In order to administer as accurate a dose as possible EP 1 058 660 B1 describes a procedure for dosing a medicine for dispensing to a single patient from a supply of equally large units or partial doses of the medicine in the form of single tablets or pellets where each unit or partial dose contains from approximately 20 to approximately 2 weight percent of the therapeutic total dose to be administered to the patient on a single occasion.

This procedure allows the dispensing of highly variable doses of a medicine from a single supply of the medicine.

Devices similar to that described in EP 1 058 660 B1 typically include a counting sensor or mechanism to ensure that the user is provided with the correct dose of the medication. However, where counting mechanisms or sensors malfunction, the devices may provide users with inaccurate doses of medication. This presents a particular problem where each tablet dispensed provides only a small partial dose, as it may not be immediately apparent to the user that, say, only 9 tablets have been dispensed as opposed to a required 12. Moreover, users receiving certain treatments may be confused or unaware that a different dispensed dose to that which is usually dispensed is erroneous.

The present invention seeks to address this problem.

In a first aspect, the invention provides a device for dispensing articles, the device comprising:

a conveying member comprising n receptacles, of which n−m are suitable for receiving articles, the receptacles being movable between an article receiving position and an article dispensing position;

a sensor for sensing the presence of articles in the receptacles, the sensor positioned between the receiving position and the dispensing position;

wherein m of said receptacles is a blank receptacle which is unable to receive an article and the sensor is unable to distinguish an empty receptacle from a blank receptacle such that the maximum number of detectable articles conveyed once n receptacles have passed the sensor is n−m, where m is at least 1.

The inventors have recognized that where dispensing devices are provided with sensors to count articles being dispensed, the accuracy of that counting is only precise as the reliability of the sensor. The invention provides a simple and convenient means for identifying if the sensor is properly functioning which stems from the realization that malfunctioning sensors often tend to "detect" the presence rather than an absence of an article. Therefore, by providing one or more blank spaces which are invisible to the sensor, it is possible to identify a malfunctioning sensor where a sensor "detects" n articles, rather than n−m articles in the receptacles of the conveyor.

In certain embodiments, the conveying member is configured to convey the receptacles in a substantially annular path.

Preferably, the receptacles for receiving articles are each configured to receive a single article, each article of substantially identical size to each other.

In some embodiments, the blank receptacle comprises a receptacle deactivated for example by means of a baffle. Preferably, any such baffle is integrally formed with one or more defining walls of the receptacle.

Preferably, the sensor comprises a photocell. In some embodiments, the or a baffle which is comprised in the blank receptacle is transparent to at least the range of wavelengths of light detectable by the photocell. It is preferred that infra-red light is detectable to the photocell.

Preferably, the device further comprises a housing in which a storage chamber for the storage of articles to be dispensed is contained or is containable. Preferably, the storage chamber is provided in a removable cassette that is releasably engageable within the housing.

It is preferred that the device also comprises a dispensing chamber to collect and hold articles fed from the storage chamber by the conveyer, the dispensing chamber including a dispensing outlet. The dispensing outlet is preferably selectively openable to dispense units of medicine held in the dispensing chamber. In some embodiments, the dispensing chamber is selectively movable between a first position in which the dispensing outlet is closed and a second position in which the dispensing outlet is open. The dispenser may include a motor to effect movement of the dispensing chamber between its first and second positions.

In some embodiments, the device further comprises a processor configured to receive data from the sensor, the data being indicative of the presence or absence of an article in one or more of the receptacles. Preferably, the processor is configured to provide an alert if the sensor indicates the presence of n articles conveyed once n receptacles have passed the conveyor, the alert to indicate the malfunction of the sensor. The alert may comprise one or more of an audible alert, a kinetic alert such as a vibrating alert, a visual alert such as a written or graphic alert or the illumination of a light emitting device (e.g. a light emitting diode).

Preferably, the processor is configured to provide an alert in the event that the sensor does not detect articles in two or more (e.g. three or more, four or more, five or more or six or more) adjacent receptacles.

In some embodiments, the processor is configured to calculate and store information indicative of the number of articles dispensed during a predetermined period and at predetermined times.

Preferably, the device comprises a motor for operating the conveyor to convey the receptacles between the receiving position and the dispensing position. The motor is preferably operable to move the conveyor in a direction from the receiving position toward the dispensing position in increments of 1/n of the effective length of the conveyor. It is preferred that the motor is arranged in communication with and is at least partly controllable by the processor. In particular, it is preferred that the processor is configured to operate the motor to dispense a predetermined number of articles at one or more predetermined times.

The processor may be programmable to provide the number of articles to be dispensed and the one or more times at which those articles are to be dispensed. For example, the processor may be programmable by means of an integrated keyboard or graphical user interface, or by communication with a remote second processor (e.g. a personal computer or server).

In some embodiments, the processor is configured to perform a test routine comprising, without dispensing any articles, activating the motor to move n receptacles past the detector and assessing the number of articles held in receptacles to provide data indicative of one or both of (i) the number of articles remaining to be dispensed by the device and (ii) the functioning of the sensor. Preferably, the processor is configured to run the test routine at a time which is not predetermined for dispensing articles.

In another aspect, the invention provides a medication dispensing device comprising a conveying member comprising n receptacles, of which n−m are suitable for receiving articles, the receptacles being movable between an article receiving position and an article dispensing position;

a sensor for sensing the presence of articles in the receptacles, the sensor positioned between the receiving position and the dispensing position;

wherein m of said receptacles is a blank receptacle which is unable to receive an article and the sensor is unable to distinguish an empty receptacle from a blank receptacle such that the maximum number of detectable articles conveyed once n receptacles have passed the conveyor is n−m, where m is at least 1, the device being for the dispensing of articles comprising discrete units of medicine.

Preferably, the device contains a plurality of discrete pharmaceutically active tablets. It is preferred that an intended dose of the tablets comprises more than n−m tablets.

In another aspect, the device contains a plurality of discrete units of medicine adapted for use in a device as described herein.

Preferably, the device is configured (for example by appropriate programming of the processor) to dispense up to a predetermined maximum number of articles within a prescribed period of time. Where the device is used for the dispensing of units of medicine to an end user, for example, a pharmacist or other medical practitioner may program the device with a prescribed dose such that the device is able to prevent accidental or intentional overdosing.

In a further aspect, the invention provides a method of identifying a fault in a sensor (e.g. in a device as described herein), the method comprising;

(i) moving n receptacles past the sensor to detect the number of receptacles containing articles, where n−m of said receptacles being suitable for holding articles and where the m receptacles unsuitable for holding articles are indistinguishable by the sensor from empty receptacles suitable for holding articles;

(ii) providing an alert to the user if the number of receptacles detected to be containing articles is greater than n−m.

In some embodiments, no articles are dispensed from the receptacles in the performance of the method.

In some embodiments, the method further comprises providing an alert to the user if no article is detected in two or more (e.g. three or more, four or more, five or more or six or more) adjacent receptacles.

In another aspect, the invention provides a method of dispensing articles from a device (such as a device as described above) the method comprising:

(i) moving n receptacles from a receiving position to a dispensing position, where n−m of said receptacles being suitable for holding articles and where the m receptacles unsuitable for holding articles are indistinguishable by a sensor from empty receptacles suitable for holding articles, the sensor being positioned between the receiving position and the dispensing position;

(ii) using the sensor to detect the number of receptacles containing articles;

(iii) providing an alert to the user if the number of receptacles detected to be containing articles is greater than n−m.

In another aspect, the invention provides a method of dispensing discrete units of medicine from a device (such as a device as described above) to conform to a predetermined dosing regime, the method comprising:

(i) moving n receptacles from a receiving position to a dispensing position, where n−m of said receptacles being suitable for holding discrete units of medicine and where the m receptacles unsuitable for holding articles are indistinguishable by a sensor from those suitable for holding discrete units of medicine, the sensor being positioned between the receiving position and the dispensing position;

(ii) using the sensor to detect the number of receptacles containing discrete units of medicine;

(iii) providing an alert to the user if the number of receptacles detected to be containing discrete units of medicine is greater than n−m.

Preferably, the method comprises dispensing up to a predetermined maximum number of articles within a prescribed period of time. Where the device is used for the dispensing of units of medicine to an end user, for example, a pharmacist or other medical practitioner may program the device with a prescribed dose such that the device is able to prevent accidental or intentional overdosing.

In another aspect, the invention provides a hardware module configured to perform the methods described above when incorporated in a device as described herein. The hardware module may comprise, for example, a chip or graphical processing unit (GPU).

There may be provided a computer program, which when run on a computer, causes the computer to configure any apparatus, including a circuit, controller, converter, or device disclosed herein or perform any method disclosed herein. The computer program may be a software implementation, and the computer may be considered as any appropriate hardware, including a digital signal processor, a microcontroller, and an implementation in read only memory (ROM), erasable programmable read only memory (EPROM) or electronically erasable programmable read only memory (EEPROM), as non-limiting examples. The software may be an assembly program.

The computer program may be provided on a computer readable medium, which may be a physical computer readable medium such as a disc or a memory device, or may be embodied as a transient signal. Such a transient signal may be a network download, including an internet download.

In some embodiments, the processor is programmable to prompt a user to activate the dosing and dispensing device to dispense a predetermined number of units of medicine at one or more predetermined times.

The device may include a display to display information to a user, which allows the dosing and dispensing device to display, for example, time, medication and/or dosage size.

The device also preferably includes a data input device to enter data into the controller and effect operation of the dosing and dispensing device in accordance with the input data.

The provision of a data input device allows a user to influence operation of the dosing and dispensing device in dependence on the user's symptoms, for example.

Preferably the display and the data input device are provided in the form of a touch-sensitive screen.

In such embodiments a visual analogue scale (VAS) may be selectively displayed on the screen to facilitate the input of data, and the visual analogue scale (VAS) may be displayed on the screen when the dosing and dispensing device dispenses one or more articles.

In particularly preferred embodiments, the device includes a memory to store times of dosing and dose sizes provided and thereby maintain an electronic log function. This in turn can be used to monitor dosage compliance. In such embodiments the dosing and dispensing device may not necessarily require the provision of an input device.

The dosing and dispensing device may include a settable alarm that emits sound or light, and/or causes the dispensing device to vibrate at one or more predetermined times. This helps to ensure that the user dispenses the required number of units of medicine and takes his or her dose of the medicine within the therapeutic window associated with the medicine.

In order to prevent illegitimate or otherwise unauthorized dispensing of articles, the device may include a lock. This reduces the risk of children, for example, dosing and dispensing units of medicine from the dispensing device.

In embodiments where the storage chamber is provided in the form of a cassette, the cassette may include a readable marker and a processor in the device may include a reader to read the marker on the cassette and thereby allow the controller to identify the articles (e.g. medicine) contained in the cassette.

This arrangement permits the controller to be pre-programmed to function in a number of predetermined modes of operation, each mode of operation being specific to a particular articles, and to then select the mode of operation applicable to the articles contained in the cassette once it has identified the articles contained in the cassette.

A preferred embodiment of the invention will now be described, by way of a non-limiting example, with reference to the accompanying figures in which.

Figure 1:
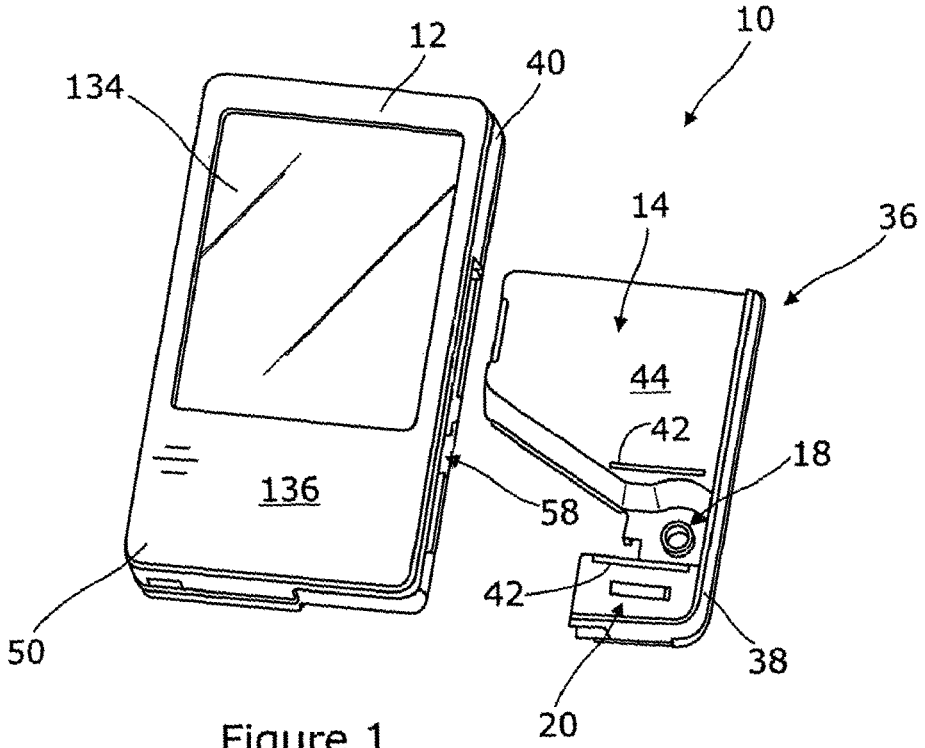
FIGS. 1 and 2 show a medicine dosing and dispensing device according to an embodiment of the invention.
Figure 2:
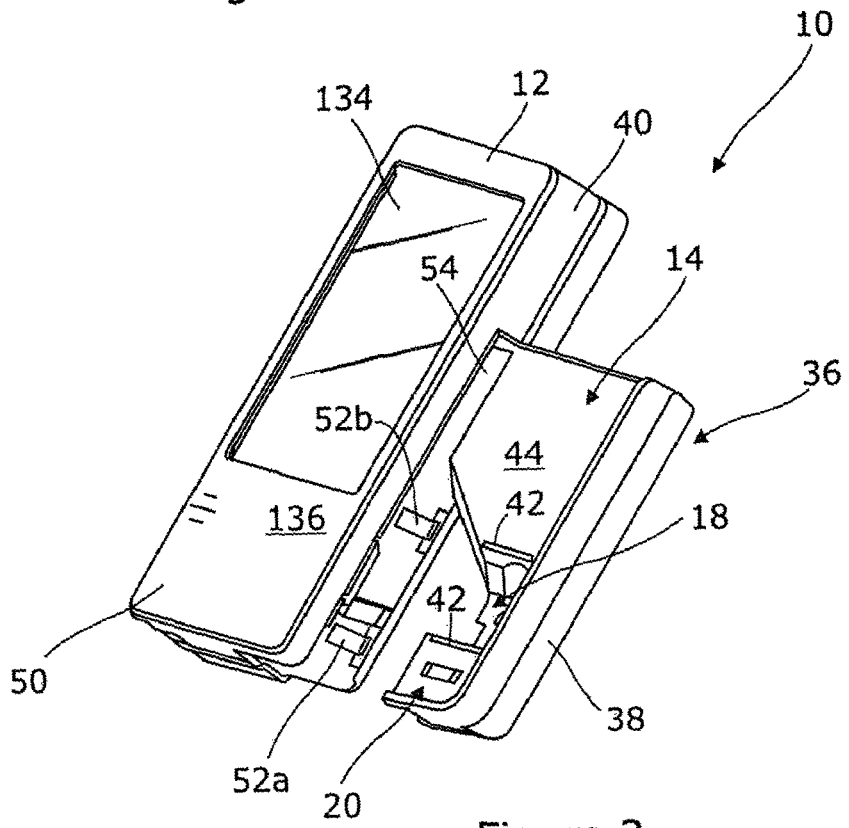

A medicine dosing and dispensing device 10 according to an embodiment of the invention is shown in FIGS. 1 and 2.

The dosing and dispensing device 10 may be comparable in size with hand held devices such as, for example, mobile telephones, thereby rendering the dosing and dispensing device 10 suitable for use as a hand held device. It is envisaged that in other embodiments the size and shape of the dosing and dispensing device 10 may be varied to render the dosing and dispensing device 10 suitable for users having limited dexterity, for example. The device 10 may also be sized and designed to be used in a fixed location.

The dosing and dispensing device 10 includes a housing 12 including a storage chamber 14 to store discrete units or tablets of medicine 16 and a feed assembly 18 located between the storage chamber 14 and a dispenser 20. In some embodiments, the dosing and dispensing device 10 also includes an impacter 22 (FIG. 3) that is operably associated with the storage chamber 14 to agitate units of medicine 16 stored in the storage chamber 14.

Figure 3:
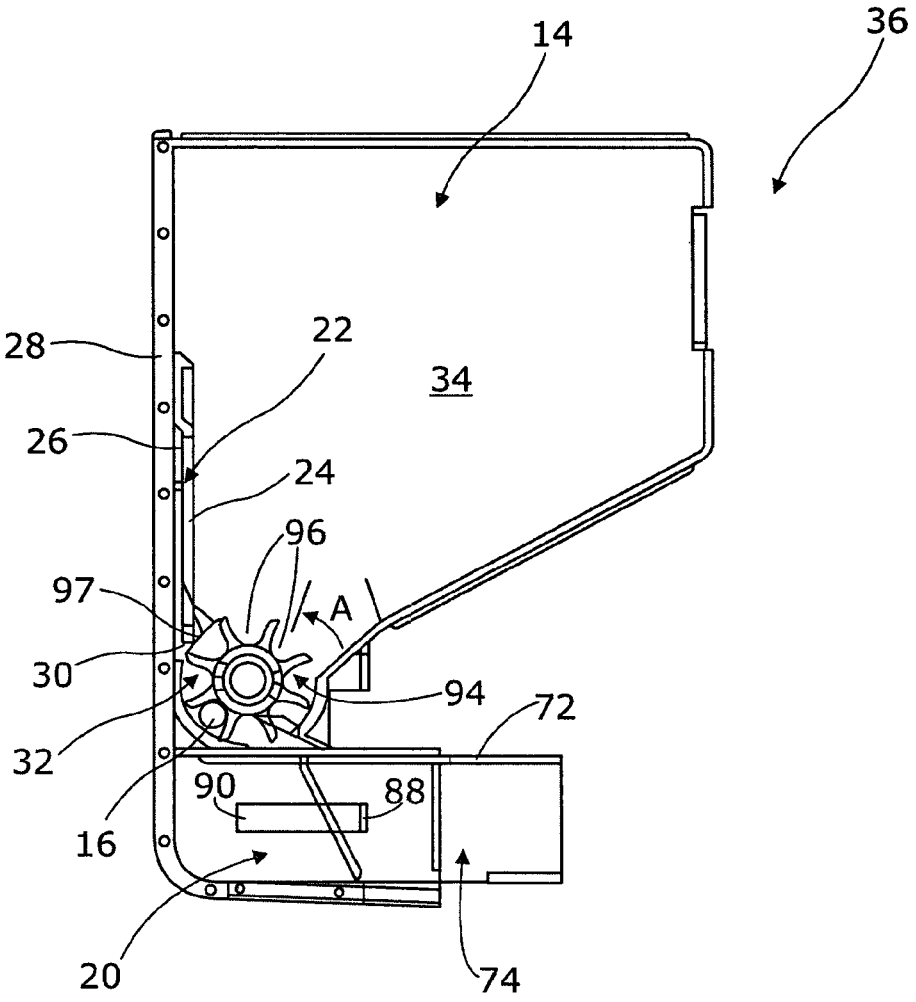
FIG. 3 shows a cross-sectional view of a cassette of the hand held medicine dosing and dispensing device of FIGS. 1 and 2.

As can be seen from FIG. 3, the impacter 22 includes a rigid element 24 fixedly connected at one end 26 to a wall 28 inside of the storage chamber 14. The impacter 22 is operably associated at a second end 30 with an actuating mechanism 32 that deflects the second end 30 of the impacter 22 towards the wall 28 of the storage chamber 14 to strain the impacter 22 such that, when released, the strained impacter 22 moves towards the interior 34 of the storage chamber 14 and impacts again units of medicine 16 stored therein.

In the embodiment shown in FIGS. 1 and 2, the dosing and dispensing device 10 includes a storage chamber 14 provided in a removable cassette 36 that is releasably engageable with the housing 12.

In other embodiments of the invention it is envisaged that the storage chamber 14 may be permanently located within the housing 12, the housing 12 including an opening to permit access to the storage chamber 14 to permit refilling thereof.

The housing 12 and cassette 36 may include mutually engageable latch members that interengage on insertion of the cassette 36 into the housing 12 to retain the cassette 36 within the housing 12. The dosing and dispensing device 10 also includes an ejection mechanism that is selectively operable to disengage the latch members and allow removal of the cassette 36 from the housing 12.

This allows the provision of a cassette 36 that, when received in the housing 12, has an external surface 38 that sits flush with an adjacent outer surface 40 of the housing 12, which enhances the appearance of the dosing and dispensing device 10.

The latch members include elongate projections 42 provided on an upper face 44 of the cassette 36 and extending in the direction in which the cassette 36 is inserted into and withdrawn from the housing 12.

Figure 9:
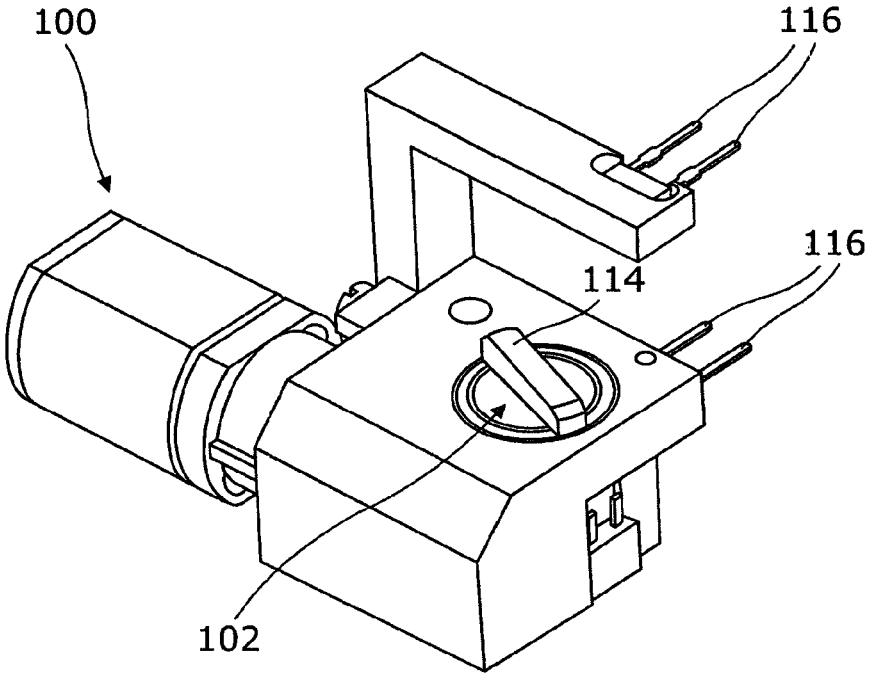
FIGS. 9 and 10 show front and rear perspective views of a drive motor of the hand held dosing and dispensing device of FIGS. 1 and 2.
Figure 10:
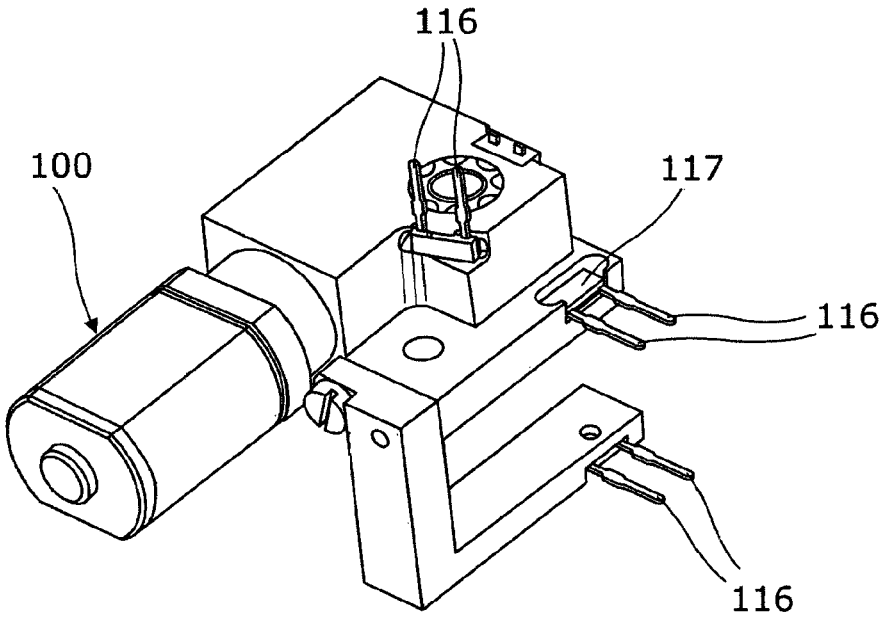

The latch members also include correspondingly shaped and sized openings 46 (FIGS. 9 and 10) provided on an inner surface 48 of an upper face 50 of the housing 12. The openings 46 are located on the inner surface 48 so as to be aligned with the projections 42 provided on the cassette 36. When the cassette 36 is fully inserted into the housing 12, an interference fit is formed to prevent sliding withdrawal of the cassette 36 from the housing 12.

In other embodiments, alternative means of securing the cassette 36 into the device 10 as may be known in the art may be utilized.

In the embodiment shown in FIGS. 1 and 2, the dispenser 20 includes a dispensing chamber 72 (FIGS. 8A and 8B) to collect and hold individual tablets 16 from the storage chamber 14 via the feed assembly 18. The dispensing chamber 72 includes a dispensing outlet 74 that is selectively openable to dispense units of medicine 16 held in the dispensing chamber 72.

The dispenser 20 forms part of the cassette 36 and the dispensing chamber 72 is movable between a first position (FIG. 8A) in which the dispensing outlet 74 is closed and a second position (FIG. 8B) in which the dispensing outlet 74 is open.

In the first position of the dispensing chamber 72, the dispensing outlet 74 is aligned with a base wall 76 of the cassette 36, the base wall 76 thereby closing the dispensing outlet 74.

In the second position of the dispensing chamber 72, the dispensing outlet 74 is aligned with an opening 78 provided in the base wall 76 of the cassette 36, the opening 78 thereby opening the dispensing outlet 74.

Figure 6:
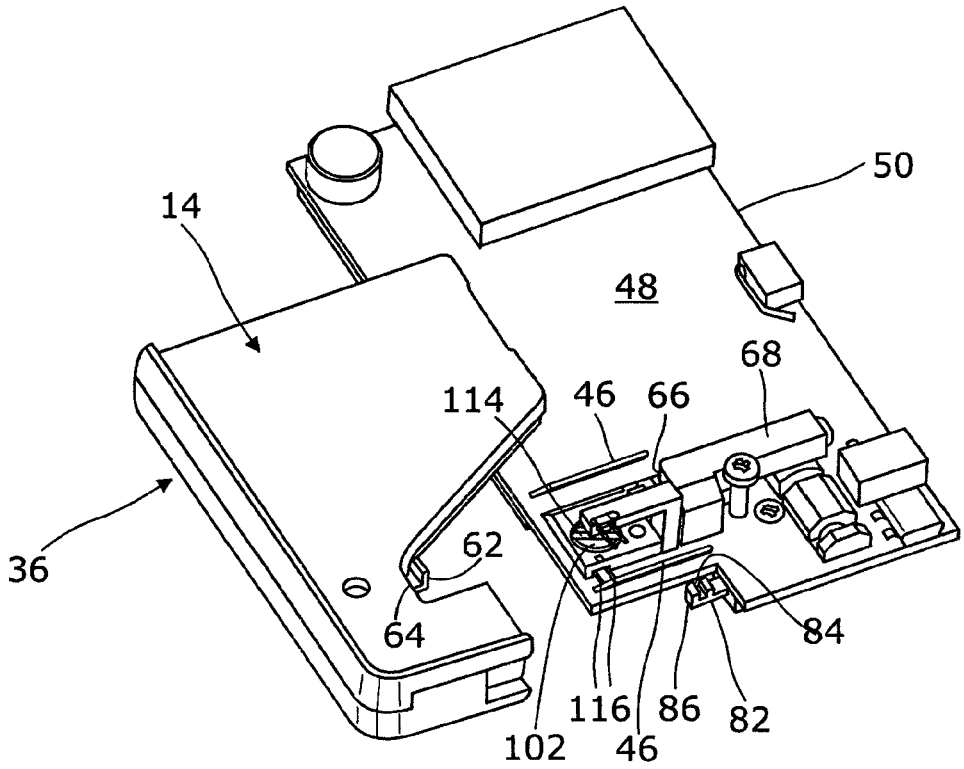
FIGS. 6 and 7 show internal controls of the hand held medicine dosing and dispensing device of FIGS. 1 and 2.
Figure 7:
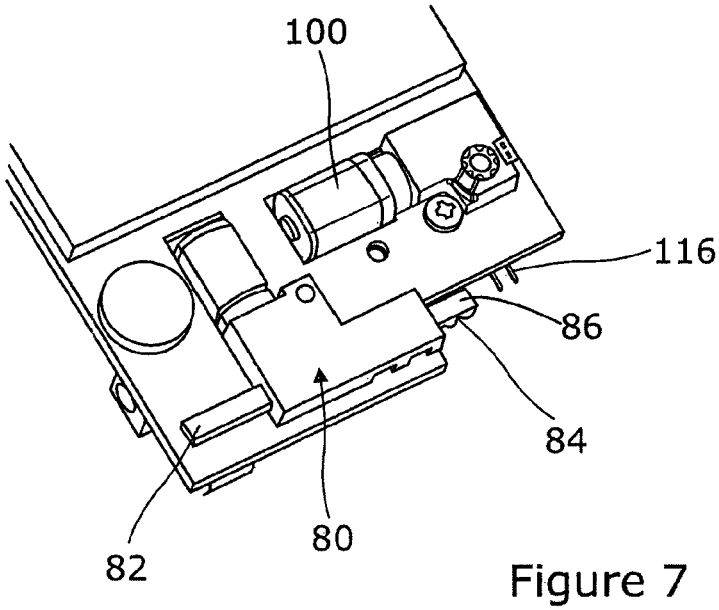

Movement of the dispensing chamber 72 between its first and second positions is effected by means of a first drive motor 80 (FIG. 7) that is operable to drive linear movement of a drive member 82 (FIGS. 6 and 7) in first and second directions. The drive member 82 defines a recess 84 at a free end 86 to receive a peg 88 protruding from the dispensing chamber 72 through a slot 90 provided in a side wall 92 of the cassette 36. Through engagement of the drive member 82 with the peg 88, movement of the drive member 82 causes movement of the peg 88 from one end of the slot 90 to the other and back, and thereby results in movement of the dispensing chamber 72 from its first position to its second position and back to its first position.

In other embodiments it is envisaged that the dispenser 20 may not include a dispensing chamber 72, and the feed assembly 18 may feed the units of medicine 16 direct to a permanently open dispensing outlet 74 of the dispenser 20.

The feed assembly 18 includes a feed wheel 94 (FIG. 2) defining a plurality of feed pockets 96 about its circumference. In the embodiment shown in FIGS. 1 and 2 the feed wheel 94 is located in the cassette 36 between the storage chamber 14 and the dispenser 20 and comprises seven pockets 96 and one blank pocket 97.

Figure 4:
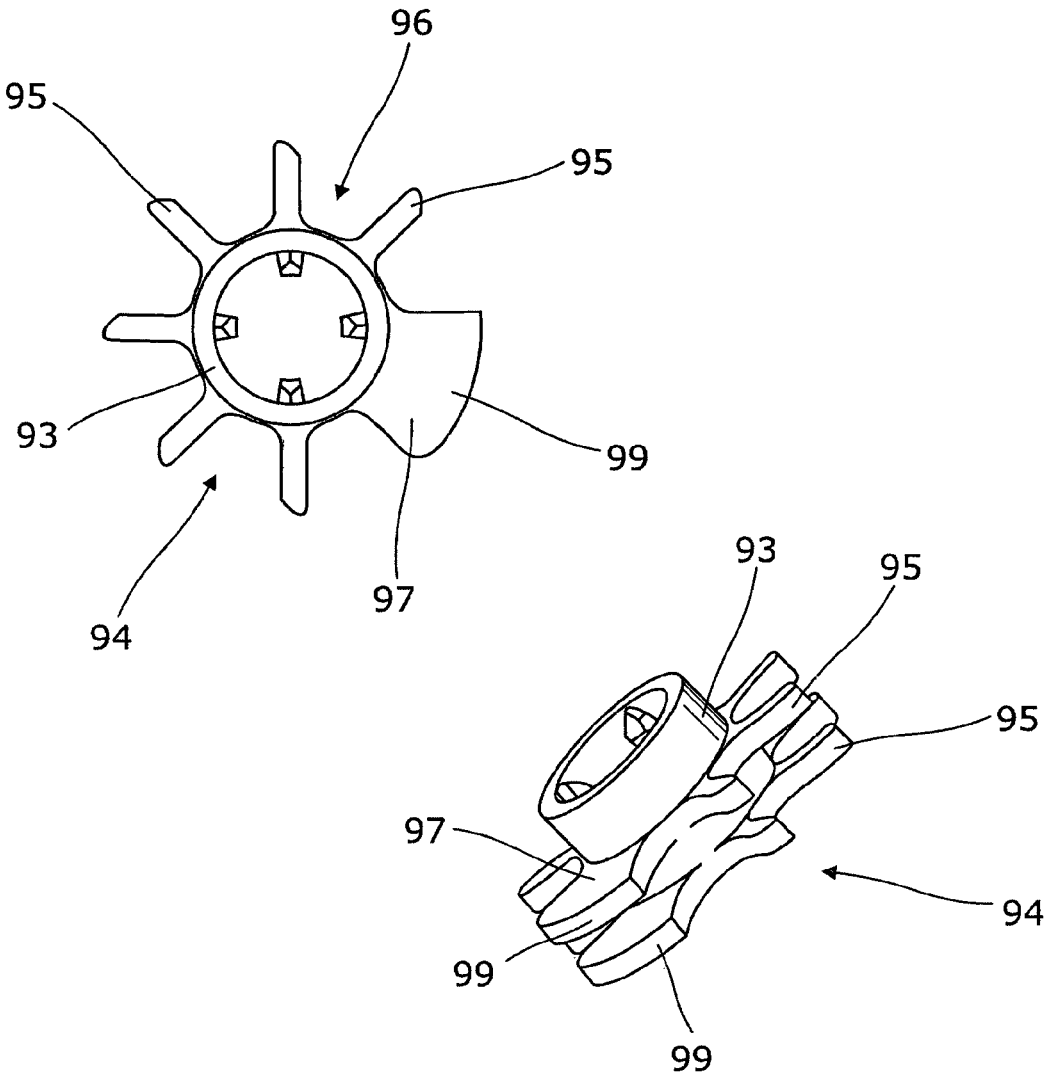
FIG. 4 illustrates a feed wheel for use in the dosing and dispensing device of FIGS. 1 and 2.

The feed wheel 94 is shown in more detail in FIG. 4 and comprises a central hub 93 and pairs of equally spaced parallel radially extending fingers 95 to form the pockets 96 therebetween. The pockets 96 are sized so as to contain a single tablet 16. The blank pocket 97 is of similar dimensions as the pockets 96 but is formed from a pair of radially extending lugs 99 which acts as a baffle to the receipt and/or containment of a tablet 16 in that part of the feed wheel 94.

The feed wheel 94 is mounted to rotate so that rotation in a first direction, which is depicted by arrow A in FIG. 4, moves the feed pockets 96 sequentially into alignment with a feed channel 98 of the storage chamber 14 to each receive a unit of medicine 16.

On further rotation of the feed wheel 94 in the first direction, the feed pockets 96 are moved sequentially into alignment with an inlet of the dispensing chamber 72 of the dispenser 20 to feed the respective units of medicine 16 into the dispensing chamber 72 dispenser 20.

The dosing and dispensing device 10 includes a second drive motor 100 (FIGS. 6, 7, 9 and 10) to drive the feed wheel 94 to rotate, the second drive motor 100 being mounted on the inner surface 48 of the upper face 50 of the housing 12.

On insertion of the cassette 36 into the internal cavity 58 of the housing 12, a drive gear 102 (FIG. 9) engages a drive shaft 104 (FIGS. 8A and 8B) that protrudes from the upper face 44 of the cassette 36.

Figure 8A:
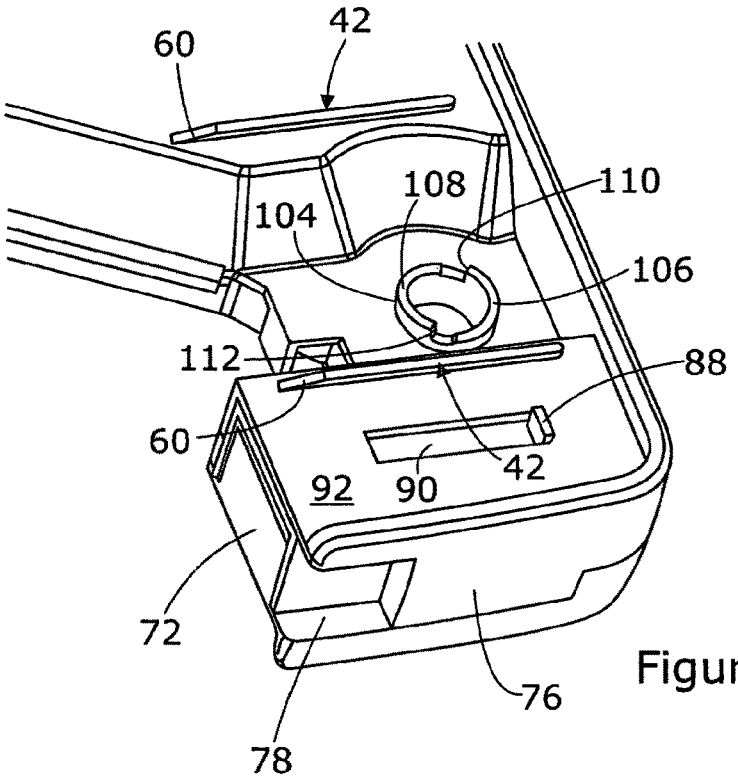
FIGS. 8A and 8B illustrate operation of a dispensing chamber of a dispenser of the cassette.
Figure 8B:
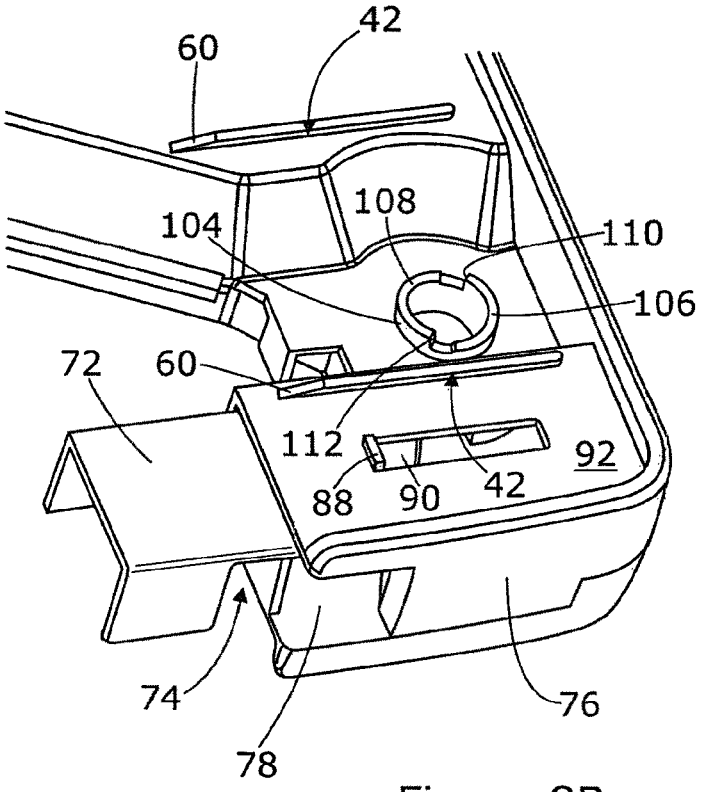

The drive shaft 104 is formed to define sloped edges 106,108 that terminate in shoulders 110,112 (FIGS. 8A and 8B).

The drive gear 102 includes an elongate lug 114 that engages the shoulders 110,112 and, on rotation of the second drive motor 100 in a first direction, drives the drive shaft 104 to rotate. This in turn causes the feed wheel 94 to rotate in the first direction.

As can be seen from FIGS. 6, 7, 9 and 10, the second drive motor 100 includes electrical contacts 116. These electrical contacts 116 engage corresponding contacts (not shown) on the cassette 36 on insertion of the cassette 36 into the internal cavity 58 of the housing 12.

In the embodiment shown in FIGS. 1 and 2, the drive shaft 104 is operable by hand to effect rotation of the feed wheel 94 in the first direction when the cassette 36 is removed from the housing. Such operation allows a user to feed units of medicine 16 from the storage chamber 14 of the cassette 36 in the event, for example, that a fault occurs within the dosing and dispensing device 10 that prevents a user from operating the dosing and dispensing device 10 to prepare and dispense a dose of the medicine contained within the storage chamber 14.

In other embodiments, where it is desirable to prevent unauthorized or illegitimate access to the units of medicine 16, the drive shaft 104 may be locked against manual rotation so that units of medicine 16 may only be accessed when the cassette 36 is mounted within the housing 12 of the dosing and dispensing device 10. In such embodiments the cassette 36 may also be sealed so as to prevent unauthorized access to any units of medicine 16 stored in the storage chamber 14 of the cassette 36.

The dosing and dispensing device 10 also includes a sensor in the form of an infra-red photocell 117 (FIG. 10) arranged relative to the inlet of the dispensing chamber 72 to detect the presence of units of medicine 16 in the feed pockets 96 of the feed wheel 94 as they pass into the dispensing chamber 72. The lugs 99 which form the blank pocket 97 are formed from a material which is invisible to the photocell 117. Accordingly, when the blank pocket 97 is presented to the photocell 117, the photocell 177 is unable to distinguish it from an empty pocket 96. The sensor 117 is controlled by and feeds information regarding the presence or absence of a tablet in the pockets to a processor (not shown) which in turn controls the rotation of the feed wheel 94.

In detecting the presence of tablets in the feed pockets 96 of the feed wheel 94, the sensor 117 effectively monitors the movement of units of medicine 16 moving from those feed pockets 96 of the feed wheel 94 into the dispensing chamber 72. The information provided by the sensor 117 to the processor allows movement of the second drive motor 100 to be controlled to drive the feed wheel 94 in the first direction so as to feed a predetermined number of units of medicine 16 to the dispenser 20.

The sensor also allows the dosing and dispensing device 10 to determine when the storage chamber 14 is empty.

In use, the second drive motor 100 drives the feed wheel 94 to rotate so as to feed units of medicine 16 from the storage chamber 14 of the cassette 36, via the feed pockets 96, to the dispensing chamber 72.

During this movement, the photocell 117 is located relative to the inlet of the dispensing chamber 72 so as to enable the dosing and dispensing device 10 to be able to determine the number of units of medicine 16 that are fed into the dispensing chamber 72.

The second drive motor 100 is controlled to continue to drive rotation of the feed wheel 94 until the dosing and dispensing device 10 determines via the photocell 117 that the required number of units of medicine 16 have been fed into the dispensing chamber 72, at which point the second drive motor 100 stops driving rotation of the feed wheel 94.

This arrangement means that the feed wheel 94 continues to turn to deliver units of medicine 16 into the dispensing chamber 72 until the required number of units of medicine 16 is fed into the dispensing chamber 72. It thereby ensures that the required number of units of medicine 16 is fed into the dispensing chamber 72 regardless of whether or not one of the feed pockets 96 fails to receive and feed a unit of medicine 16 from the storage chamber 14 to the dispensing chamber 72 during rotation of the feed wheel 94.

If the photocell 117 identifies a number of consecutive empty feed pockets 96 exceeding a predetermined number during rotation of the feed wheel 94, the dosing and dispensing device 10 may determine that the storage chamber 14 is empty.

Preferably the dosing and dispensing device 10 determines that the storage chamber 14 is empty if the photocell 117 identifies more than six consecutive empty feed pockets 96 being aligned with the inlet of the dispensing chamber 72 during rotation of the feed wheel 94.

In other embodiments, depending on the nature of the units of medicine 16, and the ease with which the units of medicine 16 move from the storage chamber 14 into the feed pockets 96, the predetermined number of consecutive empty feed pockets required to determine whether the storage chamber 14 is empty may increase or decrease.

The presence of the blank pocket 97 allows the processor to determine whether the photocell 117 is operating correctly or is malfunctioning. FIG. 5 shows a schematic of this effect.

Figure 5C:
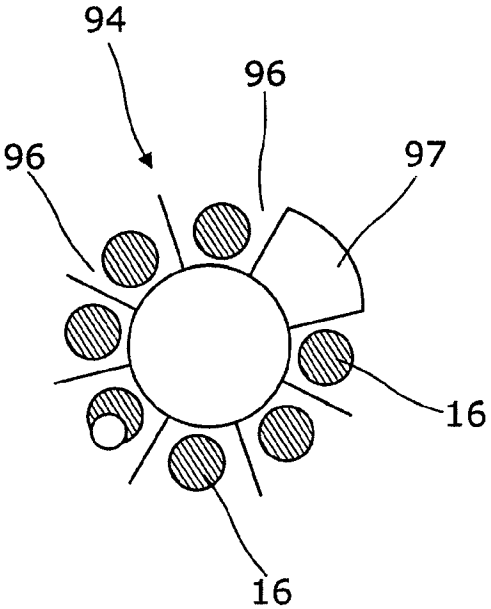
FIGS. 5A to 5C show the operation of the sensor testing feed wheel.
Figure 5B:
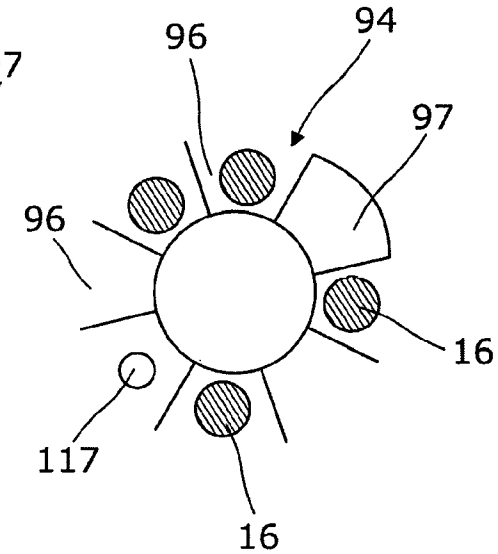
Figure 5A:
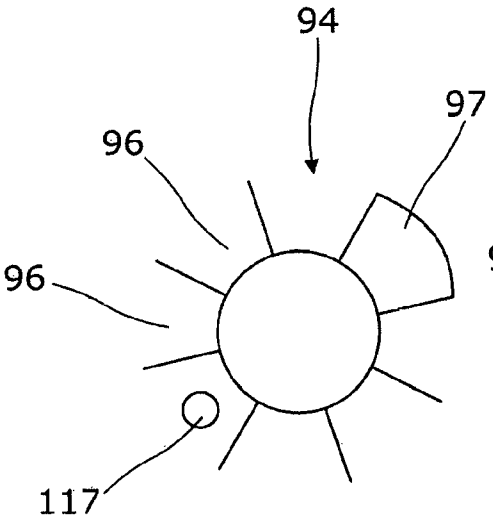

FIG. 5A shows the feed wheel 94 when it contains no tablets. Upon a complete rotation of the feed wheel 94, the photocell 117 detects no tablets if it is functioning correctly, but 8 tablets if it has malfunctioned.

FIG. 5B shows the feed wheel 94 containing a tablet in 4 of its pockets 96. Upon a complete rotation of the feed wheel 94, the photocell 117 detects 4 tablets if it is functioning correctly, but 8 tablets if it has malfunctioned.

FIG. 5C shows the feed wheel 94 containing a tablet in all 7 of its pockets 96, other than the blank pocket 97. Upon a complete rotation of the feed wheel 94, the photocell 117 detects 7 tablets if it is functioning correctly, but 8 tablets if it has malfunctioned.

Accordingly, the processor is programmed to provide an alert to the user in the event that the photocell 117 "detects" 8 tablets in the pockets 96, 97 of the feed wheel 94. The alert preferably comes in the form of a written message and/or graphic image appearing on a screen 134 on the front of the device 10 (see FIGS. 2 and 3), however it may additionally or alternatively take the form of a light such as a light emitting diode (LED) and/or an audible alert. The alert draws the user's attention to the malfunction of the sensor, enabling the user to seek the repair or replacement of the device.

The processor may also be programmed to give an alert if no tablet 1 is detected in say three or more consecutive pockets 96. This alert can be indicative of either an empty storage chamber 14 as described above, or of the malfunction of the sensor 117. In some embodiments, where the number of tablets 16 initially introduced to the storage chamber 14 is programmed into the processor and where the processor records the cumulative number of tablets 16 dispensed, the processor can provide a specific alert for a sensor 117 malfunction if consecutive pockets 96 are found to be empty.

In order to eject the cassette 36 once the storage chamber 14 is empty, or early if the patient wishes to replace the cassette 36 with a cassette 36 containing a different medicine or to gain direct access to the units of medicine contained within the cassette 36, the second drive motor 100 may be driven in a second, opposite, direction.

Rotation of the second drive motor 100 in the opposite direction causes the lug 114 to travel along the sloped edges 106,108 on the drive shaft 104. Since the drive gear 102 is fixed relative to the upper face 50 of the housing 12, movement of the lug 114 along the sloped edges 106, 108 causes movement of the cassette 36 away from the inner surface 48 of the upper face 50 of the housing 12. This movement in turn moves the projections 42 out of engagement with the openings 46 and the bias provided by the compressed spring located within the biasing member 68 pushes the cassette 36 in an outward direction and thereby ejects the cassette 36 from the housing 12.

In alternative embodiments, the cassette 36 may be ejected from the device 10 manually.

Once the cassette 36 is ejected, a user may insert a replacement cassette 36 into the dosing and dispensing device 10 in order to replenish or change the supply of medicine contained within the dosing and dispensing device 10.

In other embodiments it is envisaged that the second drive motor 100 may only be driven in the second, opposite, direction once the sensors have determined that the storage chamber 14 of the cassette 36 is empty. In such embodiments, controlled operation of the ejection mechanism prevents unauthorized or otherwise illegitimate access to the units of medicine 16 stored within the storage chamber 14 of the cassette 36.

In such embodiments the provision of an external surface 38 of the cassette 36 that is flush with the adjacent outer surface 40 of the housing 12 is advantageous in that it reduces the possibility of someone seeking to prise the cassette 36 out of the housing 12.

In the embodiment shown in FIGS. 1 and 2, the feed wheel 94 defines the actuating mechanism 32 with which the second end 30 of the impacter 22 is operably associated.

In particular, and as described above, the feed wheel 94 includes a plurality of equidistantly spaced, radially extending pairs of parallel fingers 95, adjacent fingers 95 defining the feed pockets 96 therebetween.

The length of each of the fingers 95 is such that rotation of the feed wheel 94 in the first direction moves each of the fingers 95 sequentially into engagement with a front face of the second end 30 of the impacter 22. Continued rotation of the feed wheel 94 causes deflection of the second end 30 of the impacter 22 towards the wall 28 of the storage chamber 14 as the respective finger 95 is moved across the front face until the finger 95 moves out of engagement with the second end 30 of the impacter 22. This actuates the impacter to the manner described in WO 2010/060568, the contents of which are incorporated herein in their entirety.

The processor included in the dosing and dispensing device 10 shown in FIGS. 1 and 2 is programmable to prompt a user to dispense units of medicine 16 at one or more predetermined times throughout the day.

At the or each predetermined time, the controller activates an alarm provided in the dosing and dispensing device 10 to emit sound or light and/or causes the dosing and dispensing device 10 to vibrate so as to alert the user to dispense units of medicine 16 and take his or her dose of the medicine within a therapeutic window associated with the medicine.

In the event the user does not respond to an initial alarm, the controller may be programmed to emit one or more further alarms within a predetermined time from the first alarm.

When the user is alerted to the need to dispense units of medicine 16, a message delivered on a display 134 provided on an outer surface 136 of the upper face 50 of the housing 12 prompts the user to enter a code into the dosing and dispensing device 10 via a data input device.

In the embodiment shown in FIGS. 1 and 2, the display 134 is provided in the form of a touch-sensitive screen, which also functions as the data input device.

On entry of the correct code, the dosing and dispensing device 10 is unlocked and a message delivered on the display 134 prompts the user to activate the dosing and dispensing device 10 to feed either a predetermined number of units of medicine 16 into the dispensing chamber 72 or prompts the user to identify the dose of medicine he or she requires.

In other embodiments it is envisaged that the data input device may be provided in the form of a keypad mounted on the outer surface 136 of the upper face 50 of the housing 12.

It is also envisaged that in other embodiments the lock may be omitted.

Following the required response from the user, the controller operates the second drive motor 100 to operate the feed wheel 94 to feed the number of units of medicine 16 into the dispensing chamber 72 that will provide the required dose of medicine to the user.

During operation of the feed wheel 94 to feed units of medicine 16 into the dispensing chamber 72, a sensor, preferably provided in the form of a photocell, senses the movement of each unit of medicine 16 that passes from the feed wheel 94 into the dispensing chamber 72. This allows the controller to count the number of units of medicine 16 that are fed into the dispensing chamber 72.

Once the sensor has counted the required number of units of medicine 16 being fed into the dispensing chamber 72, the controller ceases operation of the second drive motor 100 and thereby ceases operation of the feed wheel 94.

The first motor 80 is then operated to cause movement of the dispensing chamber 72 from its first position to its second position so as to open the dispensing outlet 74 of the dispenser 20 and dispense the dose of medicine held in the dispensing chamber 72 to the user.

In other embodiments, it is envisaged that the dosing and dispensing device 10 will automatically feed a predetermined number of units of medicine 16 to the dispensing chamber 72 once the dosing and dispensing device 10 is unlocked.

The controller may display further messages before, during or after operation of the second drive motor 100 to prompt the user to respond to questions concerning the nature of any symptoms he or she may be experiencing via the data input device.

In the embodiment shown in FIGS. 1 and 2, where the display 134 is a touch-sensitive screen, responses to these questions may be input via a visual analogue scale (VAS) displayed on the display 134. This allows a user to provided information concerning pain levels, for example, via the use of a straight line scale extending from zero, meaning no pain, to ten, meaning intolerable pain.

The information provided by the patient to the questions posed, via the data input device, is stored within a memory provided in the dosing and dispensing device 10 and may be accessed on the display 134 of the dosing and dispensing device 10 or by connecting the dosing and dispensing device 10 to a computer via a USB port, for example.

This facility allows a user and his or her physician to monitor the user's symptoms at the time of drug intake, for example, which may be particularly beneficial for the user and the physical in the dose-finding process.

As well as storing data input by the user, the memory provided in the dosing and dispensing device 10 may record the times at which the dosing and dispensing device 10 is activated to prepare a dose of medicine and dispense that dose. It may also record the dose prepared and dispensed each time in terms of the number of units of medicine 16. This information provides an electronic log, which may be accessed by connecting the dosing and dispensing device 10 to a computer, and provides a means for monitoring dosage compliance.

In embodiments not shown in the figures, the cassette 36 includes a readable marker (not shown) identifying the medicine contained within the storage chamber 14 of the cassette 36. A reader provided within the inner cavity 58 of the housing 12 of the dosing and dispensing device 10 reads the readable marker is read on insertion of the cassette 36 into the inner cavity 58, and allows the processor within the dosing and dispensing device 10 to identify the medicine. The readable marker may also inform the processor of the quantity of units of medicine in the cassette.

In such embodiments, the controller may be programmed to function in a number of predetermined modes of operation, each mode of operation being specific to a particular medicine, and to then select the mode of operation applicable to the medicine contained in the cassette 36 once it has identified the medicine contained in the cassette 36.

The provision of a readable marker is advantageous in circumstances where there are insufficient units of medicine contained within a cassette to allow the dosing and dispensing device 10 to feed the required number of units of medicine 16 to the dispensing chamber 72 in a single operation. In such circumstances the dispensing outlet 74 of the dispenser 20 may be opened to dispense the units of medicine 16 held in the dispensing chamber 72 and the empty cassette 36 is replaced with a replacement cassette 36. The controller may check that the replacement cassette 36 contains the same medicine before operating the second drive motor 100 to continue to feed the units of medicine 16 to the dispensing chamber 72 required to complete the dose. Preferably in such circumstances the display 134 displays a message to the user clearly identifying that the units of medicine 16 dispensed from the dispensing chamber 72 prior to replacement of the empty cassette 36 is an incomplete dose.

In other embodiments it is envisaged that the dispenser 20 forms part of the housing 12 instead of the cassette 36. In such embodiments the location of the dispensing chamber 72 in the housing 12 renders it unnecessary for an incomplete dose to be dispensed prior to replacement of an empty cassette 36.

The number of units of medicine 16 to be dispensed from the dosing and dispensing device 10 is determined by the size of the total dose required and is therefore determined by the amount of active ingredient or medicine contained in each unit of medicine 16.

The amount of active ingredient contained in each unit of medicine 16 may be chosen depending on the nature of the medicine and the side effects that arise from over or under dosing. For example, the amount of active ingredient contained in each unit of a medicine for which the side effects arising from over or under dosing are minimal may be greater than that for a medicine for which the side effects are more pronounced. This is because the greater the amount of active ingredient contained in each unit of medicine, the less possible it is to fine tune the total dose.

Consideration must also however be made of the consequences of having to store in the storage chamber 14 a relatively large number of partial doses in the form of individual units of medicine in the event each unit of medicine contains a very low amount of active ingredient.

Preferably therefore each unit of medicine contains from approximately 20% to 2% of the weight of the total dose to be administered and dispensed from the dosing and dispensing device 10 at any one time.

The units of medicine may be provided in the form of tablets or pellets, and preferably have convex or iso-diametrical surfaces so as to define a spherical or near spherical shape produced through the use of a punch having a concave surface.

In circumstances where the units of medicine are provided in the form of tablets, the tablets preferably have a diameter in the range of 1-13 mm, more preferably in the range of 2-8 mm and most preferably in the range of 2-5 mm.

In circumstances where the units of medicine are provided in the form of pellets, the pellets preferably have a size in the range of 1-8 mm and most preferably in the range of 1-4 mm.

In certain embodiments, the number of pockets 96 on the gear wheel 94 is tailored to the number of tablets 1 the user requires to achieve his or her required dose. For example, the device will be more timely in its detection of faults in the sensor 117 when the dose which is usually dispensed consists of a greater number of tablets 16 that the number of pockets on the feed wheel 94, thereby ensuring that the feed wheel completes at least a full rotation at each dispensing action. In other embodiments, however, the device comprises a memory (e.g. forming part of the processor) to allow the full rotation of the feed wheel (and thus the test of the sensor function) to be spread across two or more dispensing events.

It is also envisaged that the test of sensor 117 function may be performed without dispensing tablets 1. Such a standalone test function is useful to perform e.g. before or between tablet dispensing actions to prevent users being surprised by an inaccurate dose, should the sensor be found to be malfunctioning. This test may be performed by the provision of a retractable baffle (not shown) at the dispensing position, preventing the passage of tablets 1 from the feed wheel 94 to the dispenser 72. The deployment of the baffle may be controlled by the processor.

In some embodiments, the standalone test function may be performed automatically. For example, the processor may be programmed to perform the test at predetermined (e.g. regular) times. Such times are preferably not at the same or similar times at which the processor is programmed to dispense tablets. Additionally or alternatively, the test may be performed on the demand of the user, for example by actuation of a test button (not shown).

While devices of the invention are described above in the context of dispensing pharmaceuticals to end users, the skilled person will recognize that such devices are also useful for the dispensing of pharmaceuticals by pharmacists or other medical professionals, particularly where large numbers of discrete units of medicine are to be placed in one or more containers. Such devices may employ a different overall construction, for example so as to be optimized for use in a fixed position and to dispense large quantities of discrete units of medicine in a short period of time (e.g. 100 units a minute or more).

Indeed, in some embodiments, a suitably modified device may be utilized in an industrial setting (e.g. on a production line), where it is necessary that discrete units of product are counted accurately and where it is desirable to detect a malfunction of the counting mechanism as quickly as possible. As the skilled person understands, such discrete units of product need not be limited to pharmaceuticals.

No doubt many other effective alternatives will occur to the skilled person. It will be understood that the invention is not limited to the described embodiments and encompasses modifications apparent to those skilled in the art lying within the spirit and scope of the invention.

The invention claimed is:

1. A device for dispensing articles, the device comprising:

a conveying member comprising n receptacles, wherein a number m of said receptacles is a blank receptacle which is unable to receive an article, where m is at least 1; of which n−m are suitable for receiving articles, the receptacles being movable between an article receiving position and an article dispensing position;

a sensor for sensing the presence of articles in the receptacles, the sensor positioned between the receiving position and the dispensing position; and where the sensor is configured to detect an empty receptacle as equivalent to a blank receptacle such that the maximum number of detectable articles conveyed once n receptacles have passed the sensor is n−m.

2. A device according to claim 1, wherein the conveying member is configured to convey the receptacles in a substantially annular path.

3. A device according to claim 1, wherein the blank receptacle comprises a receptacle deactivated by means of a baffle, wherein the baffle is integrally formed with one or more defining walls of the receptacle.

4. A device according to claim 1, wherein the sensor comprises a photocell.

5. A device according to claim 1 further comprising a housing in which a storage chamber for the storage of articles to be dispensed is contained or is containable, wherein the storage chamber is provided in a removable cassette that is manually or automatically releasably engageable within the housing.

6. A device according to claim 1, further comprising a processor configured to receive data from the sensor indicative of the presence or absence of an article in one or more of the receptacles.

7. A device according to claim 1, further comprising a motor for operating the conveyor to convey the receptacles between the receiving position and the dispensing position, wherein the motor is operable to move the conveyor in increments of 1/n of the effective length of the conveyor; and/or wherein the motor is arranged in communication with and is at least partly controllable by a processor and/or wherein the processor is configured to operate the motor to dispense a predetermined number of articles at one or more predetermined times; and/or wherein the processor is programmable to provide the number of articles to be dispensed and the one or more times at which those articles are to be dispensed.

8. A medication dispensing device comprising the device of claim 1, where the articles comprise discrete units of medicine, and the device contains a plurality of discrete units of medicine.

9. A device according to claim 3, wherein the baffle which is comprised in the blank receptacle is transparent to at least the range of wavelengths of light detectable by the photocell and/or wherein infra-red light is detectable to the photocell.

10. A device according to claim 6, wherein the processor is configured to provide an alert if the sensor indicates the presence of n articles conveyed once n receptacles have passed the conveyor, the alert to indicate the malfunction of the sensor.

11. A device according to claim 6, wherein the processor is configured to calculate and store information indicative of the number of articles dispensed during a predetermined period and at predetermined times.

12. A device according to claim 10, wherein the alert comprises one or more of an audible alert, a kinetic alert such as a vibrating alert, a visual alert such as a written or graphic alert or an illuminated light emitting device.

13. A device according to claim 7, wherein the processor is configured to perform a test routine comprising, without dispensing any articles, activating the motor to move n receptacles past the detector and assessing the number of articles held in receptacles to provide data indicative of one or both of (i) the number of articles remaining to be dispensed by the device and (ii) the functioning of the sensor.

14. A method of identifying a fault in a sensor, the method comprising;

moving n receptacles past the sensor to detect the number of receptacles containing articles, where n−m of said receptacles being suitable for holding articles and where the m receptacles unsuitable for holding articles are detectable by the sensor as equivalent to empty receptacles suitable for holding articles, where m is at least 1;

(ii) providing an alert to the user if the number of receptacles detected to be containing articles is greater than n−m.

15. A hardware module configured to perform the method of claim 14.

16. A computer program stored in a tangible medium, which when run on a computer, causes the computer to configure any apparatus, including a circuit, controller, converter, or device disclosed herein to perform the method according to claim 14.

17. A method of dispensing articles from a device the method comprising:

(i) moving n receptacles from a receiving position to a dispensing position, where n−m of said receptacles being suitable for holding articles and where the m receptacles unsuitable for holding articles are detectable by a sensor as equivalent to empty receptacles suitable for holding articles, wherein m is at least 1 the sensor being positioned between the receiving position and the dispensing position;

(ii) using the sensor to detect the number of receptacles containing articles;

(iii) providing an alert to the user if the number of receptacles detected to be containing articles is greater than n−m.

18. A method according to claim 17, comprising dispensing up to a predetermined maximum number of articles within a prescribed period of time.

19. A hardware module configured to perform the method claim 18.

20. A computer program stored in a tangible medium, which when run on a computer, causes the computer to perform the method according to claim 18.

* * * * *